US005217151A

United States Patent [19]

Parsons

[11] Patent Number: 5,217,151

[45] Date of Patent: Jun. 8, 1993

[54] BACK POCKET SCABBARD FOR TACTICAL BATON

[76] Inventor: Kevin Parsons, 16 Wagon Wheel Dr., Appleton, Wis. 54915

[21] Appl. No.: 828,416

[22] Filed: Jan. 31, 1992

[51] Int. Cl.[5] ..... A45F 5/00

[52] U.S. Cl. ..... 224/253; 224/236; 224/245; 224/901; 224/914

[58] Field of Search ..... 224/191, 224, 226, 228, 224/232, 235, 236, 242, 245, 253, 914, 904, 251, 901, 227; 30/151; 269/130, 131; 273/84 R, 84 A; 24/622

[56] References Cited

U.S. PATENT DOCUMENTS

| | | | |
|---|---|---|---|
| D. 140,745 | 4/1945 | Fairbairn et al. | 224/232 |
| 918,837 | 4/1909 | Fisher | 224/227 |
| 985,499 | 2/1911 | Batchelder | 224/227 |
| 1,194,335 | 8/1916 | Jennings | 224/227 |
| 2,298,600 | 10/1942 | Stember | 224/228 X |
| 2,543,313 | 2/1951 | Dietzgen | 224/240 |
| 2,786,251 | 3/1957 | Van Buren, Jr. | 24/622 |
| 3,870,208 | 3/1975 | Theodore | 224/250 |
| 3,977,582 | 8/1976 | McMahon | 224/246 |
| 4,006,851 | 2/1977 | Kippen | 224/197 |
| 4,541,556 | 9/1985 | Collins et al. | 224/196 |
| 4,805,819 | 2/1989 | Collins | 224/232 |
| 4,953,769 | 9/1990 | Parsons et al. | 224/253 X |
| 4,955,518 | 9/1990 | Parsons et al. | 224/253 X |
| 5,152,442 | 10/1992 | Gallagher | 224/236 X |

FOREIGN PATENT DOCUMENTS

| | | | |
|---|---|---|---|
| 354464 | 8/1931 | United Kingdom | 224/226 |

*Primary Examiner*—Henry J. Recla
*Assistant Examiner*—Glenn T. Barrett
*Attorney, Agent, or Firm*—Andrus, Sceales, Starke & Sawall

[57] ABSTRACT

A scabbard for sheathing an intermediate force weapon such as an expandable tactical baton includes a front pocket for holding the baton when in the retracted position and rear pocket for holding the baton when in the fully extended, expanded position. The scabbard is designed such that it may be worn on the belt of law enforcement personnel in a position permitting a quick draw of the baton to a ready position whether or not the baton is contracted or expanded. A unidirectional fastener is utilized to guard against accidental release of the scabbard from the belt when the scabbard is properly installed and properly utilized by law enforcement personnel.

22 Claims, 2 Drawing Sheets

FIG. 3
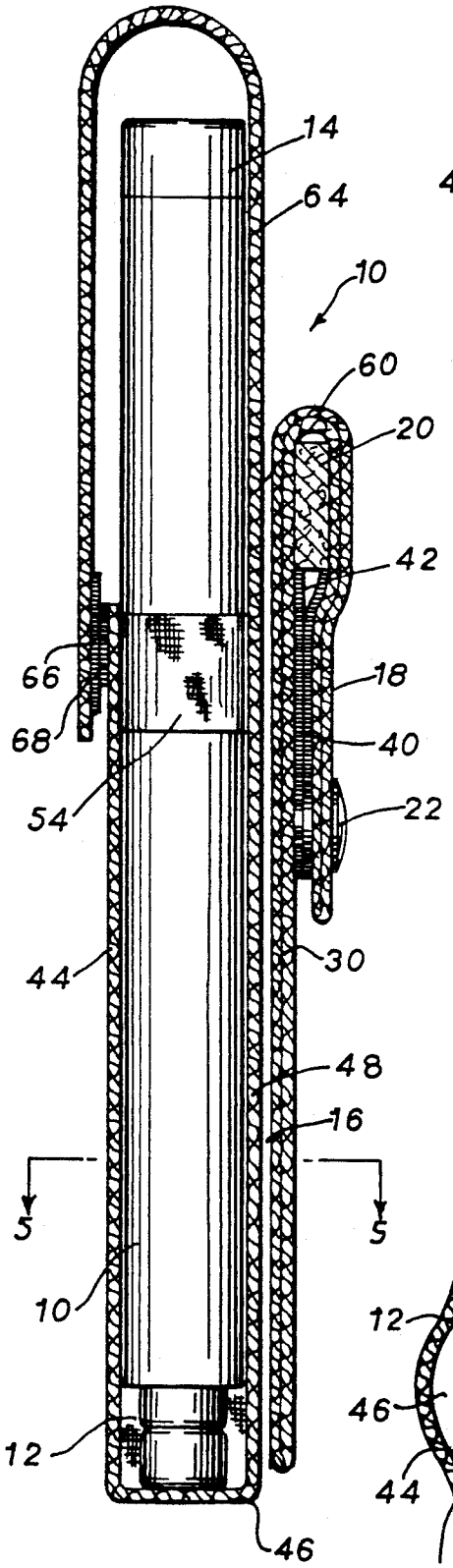
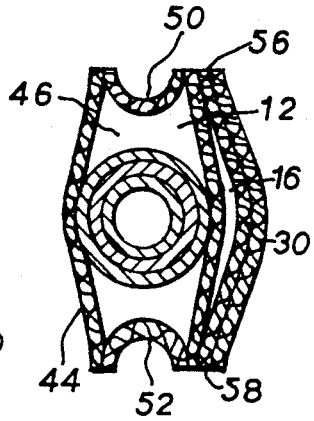
FIG. 5
FIG. 4
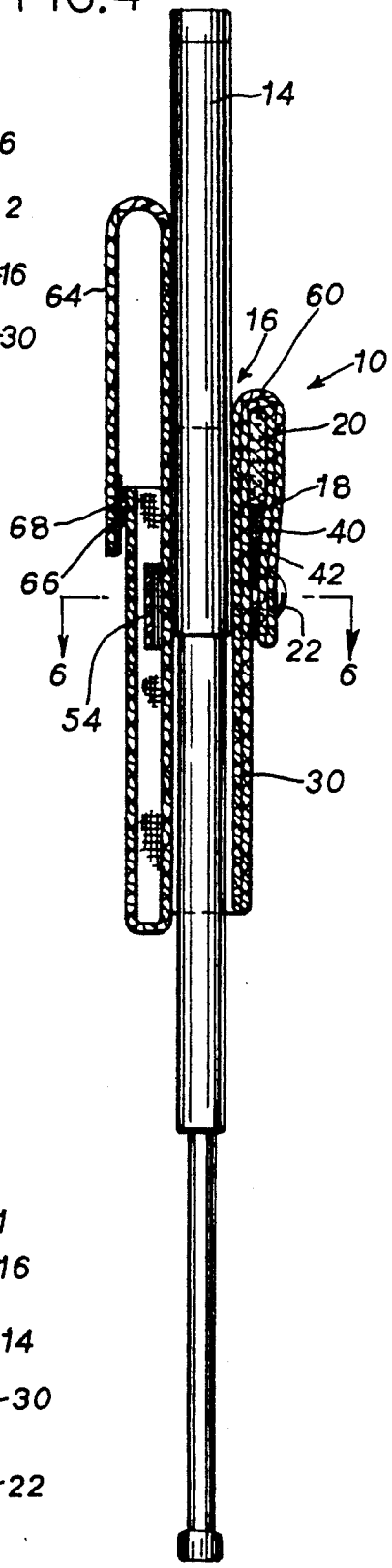
FIG. 6
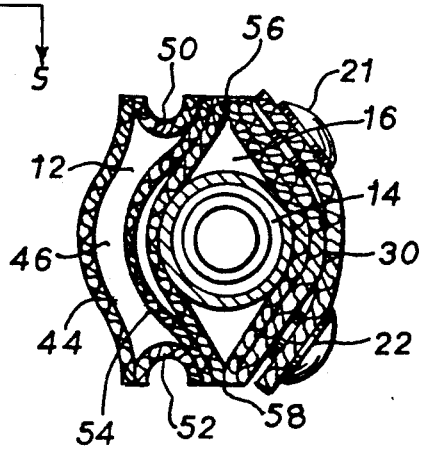

BACK POCKET SCABBARD FOR TACTICAL BATON

BACKGROUND OF THE INVENTION

1. Field of the Invention

This invention is generally related to a sheath for carrying a retractable tool mechanism and is specifically directed to a scabbard for carrying a tactical baton for use by law enforcement personnel.

2. Background of the Invention

Over the last several years, it has become desirable for law enforcement personnel to carry with them at all times intermediate force weapons. The weapon of choice is an extendable tactical baton which is lightweight, easy-to-carry, may be worn at the belt of the law enforcement personnel and may be quickly drawn to a ready position. An example of such a tactical baton is the ASP Tactical Baton manufactured by Armament Systems and Procedures, Inc., the assignee of the subject invention. The ASP Baton is made of a plurality of telescoping elements which may be retracted into the handle providing a cylindrical retracted baton of approximately seven inches in length by one inch in diameter. When extended, the baton is approximately 20 inches in length.

Typically, the law enforcement personnel will carry the baton on his person in its retracted condition and will draw the baton from a holster across his body into an at-ready position. The drawing and snapping action extends the baton to its fully expanded position. The baton may be resheathed or holstered by retracting it and replacing it in the belt scabbard carried by the law enforcement personnel.

In many applications, it is desirable to be able to stow the baton while in its fully expanded condition. Heretofore, holsters, sheaths or scabbards for stowing the baton have not been adapted for receiving the baton while in its expanded position.

Examples of sheaths for dual purpose uses are shown in U.S. Pat. No. 4,805,819 entitled "SHEATH FOR A RETRACTABLE KNIFE" issued to W. Collins on Feb. 21, 1989; U.S. Pat. No. Des. D140,745 entitled "SCABBARD OR THE LIKE" issued to W. Fairbairn et al on Apr. 3, 1945; and U.S. Pat. No. 985,499 entitled "CARTRIDGE BELT OR CARRIER" issued to F. Batchelder on Feb. 28, 1911. In particular, the Collins patent shows a sheath for housing a retractable knife both in its retracted or unretracted position with a pair of pockets, one adapted for receiving the knife blade and a second adapted for receiving a knife when the blade is housed within its handle. The Batchelder patent shows a belt carrier having a plurality of parallel pockets for carrying gun cartriges and the like. The Fairbairn design patent illustrates a sheath having a plurality of different pockets for carrying a plurality of different implements or tools on the belt of the wearer.

While belt carried sheaths or scabbards are well known, none of the prior art scabbards are readily adaptable for properly carrying an intermediate force weapon in both its retracted position and its extended position in such a manner that the weapon may be quickly drawn to a ready position and quickly repositioned in the scabbard whether or not the weapon is in the contracted or fully extended position.

SUMMARY OF THE INVENTION

The subject invention is directed to a belt carried scabbard for housing an intermediate force weapon such as an expandable baton in both the retracted and extended positions. The scabbard is designed such that it may be mounted firmly on the belt of law enforcement personnel in a position permitting quick draw of the baton to a ready position whether in the retracted condition or the fully extended, expanded condition.

In the preferred form of the invention, the scabbard includes a front pocket which is designed to frictionally hold the retracted baton in a holstered position with the handle sufficiently exposed to permit a quick draw by the law enforcement personnel. A second, back pocket is placed directly behind the front pocket and includes open ends, whereby the extended baton may be placed in the back pocket and frictionally held in position, with the handle exposed in approximately the same position as when the baton is placed in the front pocket, again permitting a quick draw of the fully extended baton.

In an alternative embodiment of the invention, a flap may be included to cover the exposed handle when the baton is stowed in the front pocket, protecting the baton against the elements and minimizing the chance of accidental removal of the baton from the scabbard by unauthorized persons.

It is an important feature of the baton that the belt loop adapted for receiving the uniform belt of the law enforcement personnel includes a one-way fastener, permitting ready placement of the scabbard on the belt while assuring that the scabbard cannot be inadvertently removed from the belt when being properly utilized by the law enforcement personnel.

In the preferred embodiment of the invention, the scabbard is made of a flexible, non-stretchable material such as ballistic weave nylon or the like and includes a resilient band in the front pocket for engaging and frictionally holding the stowed, retracted baton in position. Where the flap cover is utilized, a quick release fastener such as a hook and loop-type fastener system is utilized to secure the flap to the front of the scabbard. Also, a quick release hook and loop-type fastener system is incorporated in the belt loop to permit a tight fit around the belt of the uniform regardless of the width of the belt. A one-way friction snap mechanism is also utilized on the belt loop to assure a rigid and secure connection, for mounting the scabbard on the uniform belt.

It is, therefore, an object and feature of the subject invention to provide for a multi-purpose scabbard for holstering an intermediate force weapon such as an expandable baton in both the retracted and extended, fully expanded conditions.

It is a further object and feature of the subject invention to provide for a scabbard which will properly holster the baton for a quick draw to the ready position, whether the baton is in the retracted position or the expanded position.

It is yet another object and feature of the subject invention to provide for a belt mounted scabbard which is securely and quickly mounted on the belt, with a one-way release assuring that the scabbard cannot be inadvertently removed from the belt during proper utilization by law enforcement personnel.

Other objects and features of the subject invention will be readily apparent from the accompanying drawing and detailed description of the preferred embodiments.

BRIEF DESCRIPTION OF THE DRAWINGS

FIG. 3 is a section view of the scabbard taken generally along the line 3—3 of FIG. 2.

FIG. 4 is a view, similar to FIG. 3, showing the baton as carried by the scabbard when in the fully extended position.

FIG. 5 is a section view taken generally along the line 5—5 of FIG. 3.

FIG. 6 is a section view taken generally along the line 6—6 of FIG. 4.

DETAILED DESCRIPTION OF THE PREFERRED EMBODIMENTS

Figure 1:
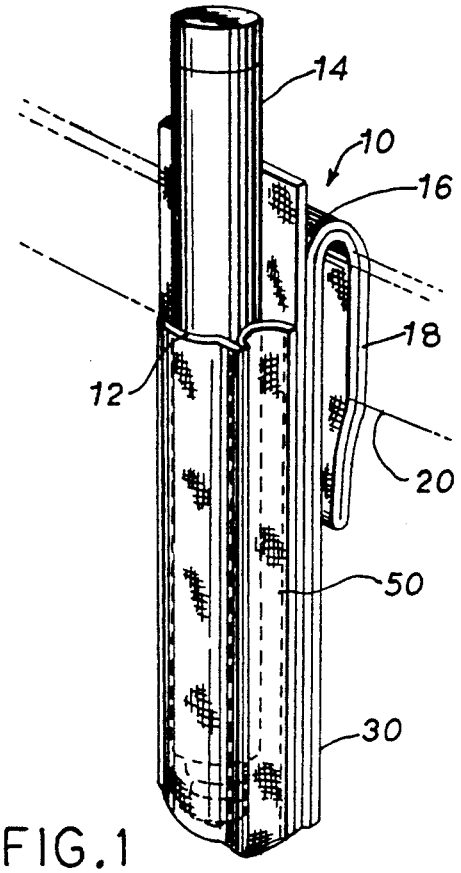
FIG. 1 is a forward facing perspective view of the scabbard in accordance with the subject invention.
Figure 7:
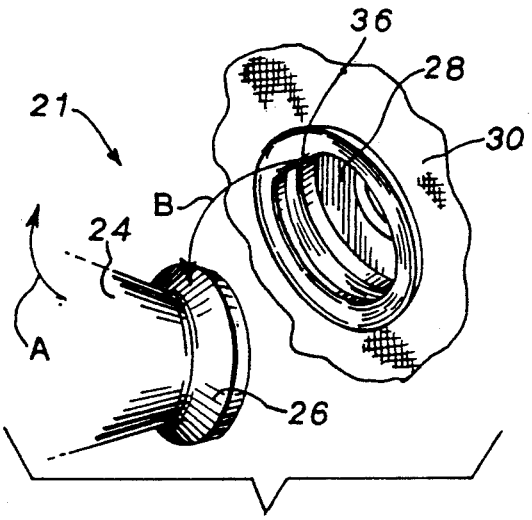
FIG. 7 is an enlarged, fragmentary perspective view showing the operation of the one-way friction snap.
Figure 8:
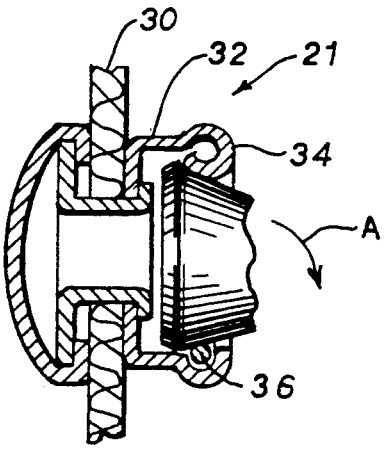
FIG. 8 is an enlarged, fragmentary section view taken generally along the line 8—8 of FIG. 2.

The scabbard 10 of the subject invention is shown in FIG. 1 and includes a front pocket 12 for holding a baton 14 in its contracted position and a rear pocket 16 for holding the baton in its extended position (also see FIG. 4). The scabbard of the preferred embodiment includes a loop flap 18 adapted to be placed around the belt 20 (shown in phantom) for securing the scabbard to the belt of law enforcement personnel. As is more clearly shown in FIG. 2, the loop flap 18 includes one or more quick release fasteners such as the friction snaps 21 and 22 which are adapted to permit ready installation of the scabbard on the belt 20. As is more clearly shown in FIGS. 7 and 8, the quick release snaps 21 and 22 are of the type having a one-way release system, assuring that the scabbard, when properly utilized by law enforcement personnel, is not inadvertently released from the belt 20. As is specifically shown, the snap 21 includes a post 24 having an enlarged end 26 adapted to be received in the socket 28 which is mounted directly on the back wall 30 of the scabbard 10. Typically, the snap socket member 28 is riveted to the fabric 30 in the manner well known to those who are skilled in the art. The socket member 28 includes an upstanding rim 32 terminated in a rounded lip 34 which is slightly smaller than the widest or largest diameter of the post end 26, permitting the post end 26 to be placed in the socket 28 with the snap fit, with the rolled lip 34 firmly engaging the base 26 of the post. In the preferred embodiment, a one-way release is used, which includes a flat or abutment member 36 on the rolled lip 34, prohibiting removal of the post 24 from the snap socket 28 unless the post 24 is first pulled in the direction of arrow A to provide ample clearance to remove the post 24 from the snap socket around the abutment member 36 and then in the direction of arrow B to remove the post from the socket. In the preferred form of the invention, one or more of the snaps 21, 22 may be utilized to firmly secure the scabbard 10 to the belt 20.

As is shown in FIGS. 3 and 4, the loop flap 18 may also include a quick release hook and loop-type fastener pad 40 which covers substantially the entire surface of the inside wall of the loop flap 18 and the complementary hook and looptype fastener pad 42 which covers a complementary portion of the surface of the back wall 30 of the scabbard. This permits the size of the loop identified by the loop flap 18 to be customized for adjusted to the particular width of the belt 20, providing a firm mounting for the scabbard on the belt, assisting in providing a quick release, quick draw sheath or scabbard for the baton 10. The resilient pads 40 and 42 permit the scabbard to be held snugly on the belt 20 by tightening the belt loop flap 18 around the perimeter of the belt. This also permits the scabbard to be angle relative to the belt to accommodate quick-draw requirements. In practice, it has been found that the scabbard works best when the belt 20 is secured near the top of the loop 18, as shown in the drawings, with the handle of the baton angled slightly forward to individual feel. When the baton is drawn from the front pocket, the fastener pads 40 and 42 separate or "tear", causing the scabbard to move up on the belt during the drawing action. This minimizes the twisting action which is normally caused by the resilient strap 54 holding the baton as it is withdrawn.

Placement of the snaps 21 and 22 near the bottom of the loop flap 18, as shown, assures that the scabbard does not become disengaged from the belt and provides a solid position stop for disengaging the baton from the scabbard during the drawing action. The holster may be repositioned on the belt by re-engaging the fastener pads 40 and 42.

In the preferred embodiment of the invention, the scabbard is made of a flexible, non-stretchable, durable material such as a ballistic weave nylon manufactured by DuPont or the like and includes a front wall 44 for defining the front wall of the front pocket 12. The front wall 44 is made of a single piece of material which loops down under the bottom of the pocket to form the closed end 46 and then is folded or looped back up to form the back wall 48 of the front pocket which is common to and defines the front wall of the back pocket 16 (see FIG. 2). A pair of side walls 50 and 52 are edge stitched to the front walls 44 and back wall 48 of the front pocket 12 of the scabbard to define the side walls thereof. In the preferred form of the invention, the pocket is expandable to accept tactical batons 14 of varying diameter. This is accomplished in the preferred embodiment by providing a C-shaped contour to the end walls 50 and 52 (see FIGS. 5 and 6), the concave, flexible outside walls being expandable and contractible to define the size of the opening of the pocket 12.

As is better seen in FIGS. 3 and 5, the front pocket includes a resilient, stretchable band 54 which is adapted to receive the baton 14 for securely holding the baton in position in the scabbard. This assures a secure, frictionally held engagement of the baton, minimizing the risk of inadvertent removal of the baton from the scabbard.

As is better shown in FIG. 4, the back pocket 16 of the baton is provided by a piece of rectangular elongate material 30 defining the back wall of the scabbard which is stitched along its side edges, as shown at 56 and 58 to define an open ended slotted passageway 16 which is adapted for receiving the baton 14 in its fully extended position. The handle of the baton extends above the uppermost point of the common wall 48 between the front and back pockets and the highest point 60 of the belt loop flap, permitting a quick grasping and a quick draw of the baton to a ready position when the scabbard is properly worn on the belt of law enforcement personnel.

Figure 2:
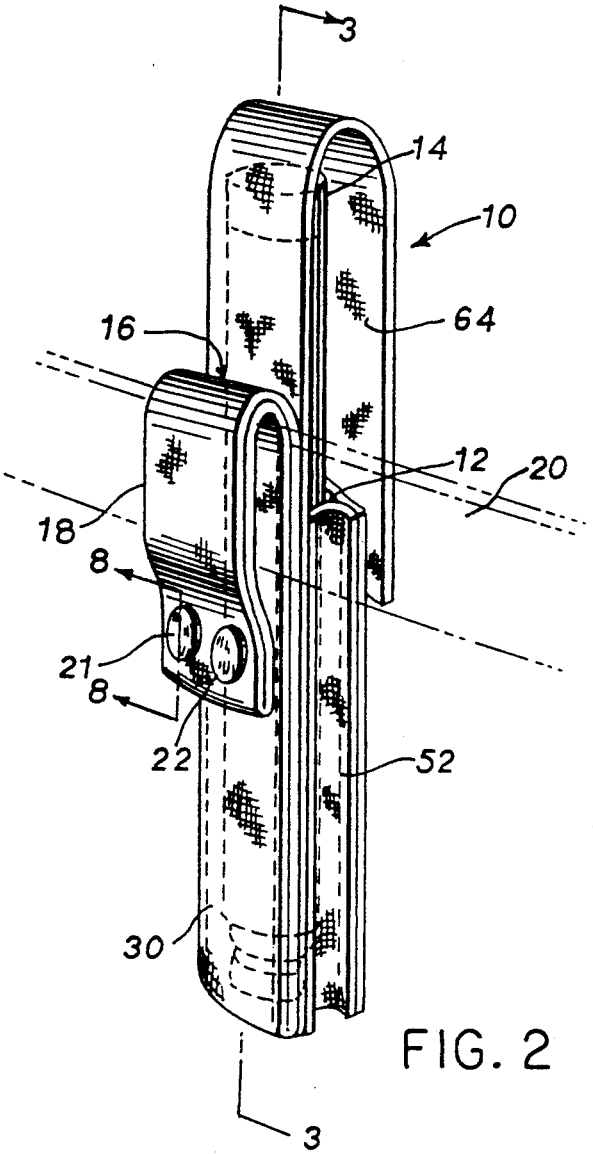
FIG. 2 is a reverse facing perspective view of a scabbard similar to FIG. 1, but including the alternative front pocket flap.

As is shown in FIGS. 2–4, the common wall 48 can be extended up above the handle 10 of the baton to define a loop flap 64 for covering the baton handle when the baton is stowed in the contracted position in the front pocket 12. This embodiment of the invention would be utilized when a quick draw to a ready position from a stowed contracted position is not required. Where the flap 64 is incorporated in the scabbard, a quick release mechanism for securing the flap in the closed position is provided by the hook and loop-type fastener pad 66 provided on the flap 64 and a complementary hook and loop-type fastener pad 68 provided on the front wall 44 of the front pocket 12.

While specific features and embodiments of the invention have been described herein, it will be readily apparent that the invention encompasses all modifications and enhancements within the scope and spirit of the following claims.

I claim:

1. A scabbard adapted to be mounted on a belt for holding an expandable baton for law enforcement use, the baton being of the type axially expandable between retracted and extended positions, the scabbard comprising:

a. a front pocket having an open top, a closed bottom and elongated sidewalls extending from the top to the bottom for receiving and supporting the baton when in the retracted position;

b. a back pocket connected to and parallel to the front pocket and having an open top and an open bottom and elongated sidewalls extending from the top to the bottom for defining an open ended channel for receiving and supporting the baton when in the extended position; and c. a support member secured to one sidewall of the back pocket and adapted for mounting the scabbard on the belt.

2. The scabbard of claim 1, wherein a common wall defines a rear sidewall of the front pocket and a front sidewall of the back pocket.

3. The scabbard of claim 2, wherein said common wall is constructed of a flexible, non-stretchable material and extends above the top of the front pocket for defining a flap adapted to be folded over the open top of the front pocket for protecting a retracted baton placed therein.

4. The scabbard of claim 3, further including a releasable fastener on said flap for selectively securing the flap in a closed position over the open top of the front pocket.

5. The scabbard of claim 4, wherein the fastener is of the quick release type.

6. The scabbard of claim 1, wherein said front pocket further includes a flexible, stretchable band having opposite ends secured to one side wall thereof inside the pocket and adapted for receiving the baton for resiliently holding the baton against said one side wall when in the front pocket.

7. The scabbard of claim 1, wherein a back sidewall of the back pocket is constructed of a flexible, non-stretchable material and includes said support member, said support member comprising:

a flap having a length extending beyond the open top of the back pocket and being foldable back over said back sidewall for defining a loop adapted for receiving the belt; and a releasable member for selectively securing the flap to said back side wall.

8. The scabbard of claim 7, wherein said releasable member comprises a first hook and loop fastener element on a portion of the back sidewall adjacent said back pocket and a second hook and loop fastener element on a portion of the flap.

9. The scabbard of claim 8, wherein said first fastener element extends along the back sidewall of the back pocket and wherein said second fastener element extends along of said flap.

10. The scabbard of claim 9, wherein the belt may be selectively placed in the loop and held in place therein by the first and second fastener elements.

11. The scabbard of claim 10, wherein the scabbard slides along the belt during a drawing action for removing the baton from the front pocket and the releasable member forms a positive stop on the loop for engaging and stopping the movement of the belt therein.

12. The scabbard of claim 7, further including a releasable latch having a first, latch keeper element secured to said back sidewall and a second, latch striker element secured to the flap and adapted to be selectively, releasably received and secured in said first, latch keeper element.

13. The scabbard of claim 12, wherein said releasable latch is a friction snap set having a restriction member on the striker element for precluding separation of the striker element from the keeper element when a releasing force is applied to the striker element in a predetermined direction.

14. The scabbard of claim 1, wherein said front pocket has a front sidewall and a back sidewall and the front sidewall, back sidewall and closed bottom of the front pocket are formed of a single sheet of flexible, non-stretchable material formed into a generally U-shape and wherein opposite outer edge sidewalls extend between the first sidewall and the back sidewall thereto to form an elongated pocket.

15. The scabbard of claim 14, wherein the outer edge sidewalls are made of a flexible non-stretchable material.

16. The scabbard of claim 14, wherein the front sidewall of the back pocket is coextensive with the back sidewall of the front pocket and has common end and common side edges therewith, and wherein the common side edges are secured together.

17. A scabbard adapted to be mounted on a belt of a law enforcement personnel uniform for holding an expandable baton in a holster like position for quick draw, the baton being of the type axially expandable between retracted and extended positions, the scabbard comprising:

a. a front pocket having an open top, a closed bottom and elongated sidewalls extending from the top to the bottom for receiving and supporting the baton when in the retracted position;

b. a flexible, stretchable band having opposite ends secured to one side wall of the front pocket inside the pocket and adapted for receiving the baton for resiliently holding the baton against said one side wall when in the front pocket;

c. a back pocket parallel to the front pocket connected to and and having an open top and an open bottom and elongated sidewalls extending from the top to the bottom for defining an open ended channel for receiving and supporting the baton when in the extended position; and d. a support member secured to one sidewall of the back pocket and adapted for mounting the scabbard on the belt.

18. The scabbard of claim 17, wherein a back sidewall of the back pocket is constructed of a flexible, non-stretchable material and includes said support member, said support member comprising:

a flap having a length extending beyond the open top of the back pocket and being foldable back over said back sidewall for defining a loop adapted for receiving the belt;

a first releasable member for selectively securing the flap directly to said back side wall; and a second releasable member comprising a latch having a first, latch keeper element secured to said back sidewall and a second, latch striker element secured to the flap and adapted to be selectively, releasably received and secured in said first, latch keeper element.

19. The scabbard of claim 18, wherein said first releasable member comprises a first hook and loop fastener element on a portion of the back sidewall adjacent said back pocket and a second hook and loop fastener element on a portion of the flap, the first element extending along the back sidewall and the second element extending along of said flap.

20. The scabbard of claim 18, wherein said latch is a friction snap set having a restriction member on the striker element for precluding separation of the striker element from the keeper element when a releasing force is applied to the striker element in a predetermined direction.

21. The scabbard of claim 17, wherein said front pocket has a front sidewall and a back sidewall and the front sidewall, back-sidewall and closed bottom of the front pocket are formed of a single sheet of flexible, non-stretchable material formed into a generally U-shape and wherein opposite outer edge sidewalls extend between the first sidewall and the back sidewall thereto to form an elongated pocket, and wherein the outer edge sidewalls are made of a flexible non-stretchable material.

22. The scabbard of claim 21, wherein the front sidewall of the back pocket is coextensive with the back sidewall of the front pocket and has common end and common side edges therewith, and wherein the common side edges are secured together.

* * * * *